US007591033B2

(12) United States Patent
Theriault

(10) Patent No.: US 7,591,033 B2
(45) Date of Patent: Sep. 22, 2009

(54) SELF STORING SEATING COMFORT ARTICLE

(76) Inventor: Michele E. Theriault, 4651 29th Ave. NW., Calgary, Alberta (CA) T3B-0J1

( * ) Notice: Subject to any disclaimer, the term of this patent is extended or adjusted under 35 U.S.C. 154(b) by 24 days.

(21) Appl. No.: 11/355,521

(22) Filed: Feb. 17, 2006

(65) Prior Publication Data

US 2007/0130693 A1 Jun. 14, 2007

(30) Foreign Application Priority Data

Dec. 15, 2004 (CA) ..... 2490728

(51) Int. Cl.
*A47G 9/06* (2006.01)

(52) U.S. Cl. ..... 5/417; 5/419; 5/653; 5/656

(58) Field of Classification Search ..... 5/417–420, 5/709, 656, 653, 485, 490; 297/219.1, 228.1; 383/4

See application file for complete search history.

(56) References Cited

U.S. PATENT DOCUMENTS 3,176,315 A * 4/1965 Freund ..... 2/69
3,774,249 A * 11/1973 Ybarra et al. ..... 5/419
3,877,092 A * 4/1975 Gaiser ..... 5/413 R
4,793,012 A * 12/1988 LaPorte ..... 5/420
5,454,125 A * 10/1995 Ratkowski ..... 5/417
5,785,219 A * 7/1998 Kraft ..... 224/576
5,887,300 A * 3/1999 Pond ..... 5/420
5,920,931 A 7/1999 Zuehlke et al.
6,223,367 B1 5/2001 French et al.
6,371,641 B1 * 4/2002 Wilson, Jr. ..... 383/4
6,393,638 B1 * 5/2002 MacColl ..... 5/419
6,493,891 B1 * 12/2002 Livingston ..... 5/636
6,704,953 B2 * 3/2004 Fishman ..... 5/413 R
6,783,175 B1 * 8/2004 Henderson ..... 297/4
6,802,092 B1 * 10/2004 Klein ..... 5/420
7,225,483 B1 * 6/2007 Remblad ..... 5/417

FOREIGN PATENT DOCUMENTS

CA 2216624 A1 3/1999
CA 2 490 728 A1 6/2006

* cited by examiner

*Primary Examiner*—Michael Trettel
(74) *Attorney, Agent, or Firm*—Slater & Matsil, L.L.P.

(57) ABSTRACT

A compact self-storing seating comfort article is described for providing comfortable seating accommodation to individuals. The seating comfort article is particularly useful to individuals attending indoor or outdoor events, in which bleacher or ground seating is typical. The seating comfort article includes at least two coverings; a blanket and an attached seat pad that may be easily folded or rolled into an attached reversible pouch for transportation or storage without the need for or use of zippers, snaps or straps. The seat pad may be quilted, foam filled, or inflatable, and may further include a third layer extendable ground sheet storable within the seat pad or attached pouch. The seat pad and blanket may include a water resistant layer, and the article includes a carry strap. The article components may be used in conjunction or independently, as well as be converted between several functional positions for versatility of use by the individual desiring comfortable accommodation in a seated position or when lying down.

20 Claims, 4 Drawing Sheets

Longitudinal Cross-Sectional View (Storage Pocket Position Variations Shown)

Rolled Up View

Longitudinal Cross-Sectional View
(Storage Pocket Position Variations Shown)

Longitudinal (Blanket Stored) View

Longitudinal (Rolling) View

Cross Section (Rolled Up) Side View

Rolled Up View

Top View (Rolled Out)

Longitudinal Cross Section of Blanket Pocket Fold

Longitudinal (Additional Layer(s)) View

Longitudinal (Additional Layer(s) Stowed) View

Bottom View (Embodiments of Figure 8A and 8B)

In Use On Chair With Blanket Stored View

SELF STORING SEATING COMFORT ARTICLE

CONTINUITY DATA

This application claims priority to Canadian application 2,490,728, filed Dec. 15, 2004.

FIELD OF THE INVENTION

The present invention, the SELF STORING SEATING COMFORT ARTICLE herein referred to as the "invention" or the "article," relates generally to articles for providing comfort to a user. More particularly, the present invention relates to a self-storing, article that can be placed on, and is readily adaptable to any seating surface and/or over a seated individual to provide comfortable seating accommodation.

BACKGROUND OF THE INVENTION

There are many activities people seek to enjoy, such as outings to parks or attendance at outdoor and indoor sporting events. Accommodating clean, dry, warm and comfortable seating in an easy and satisfactorily adequate manner is always problematic.

For activities such as indoor and outdoor sporting events, camping, picnicking, etc., insufficient formal seating is available. Spectators often sit on lawn chairs or on the ground. In such situations, a blanket is commonly used to provide comfort while seated.

When seating accommodation is provided at events or in recreational settings, it is often in the form of bleachers, chairs, or benches of plastic, metal or wood. Such accommodations are generally quite uncomfortable and can often be cold, dirty and or damp. This may diminish overall enjoyment of the activity and may deter individuals from attending outdoor events, including individuals who are elderly or frail.

When attending an outdoor event, an individual may gather a multitude of various items necessary for user comfort or protection, such as blankets, seat cushions, and hand and head warming garments. Transportation of these items may become a considerable burden to the user, and loose items may be forgotten or lost at the event.

Multipurpose combination articles are currently available for improving comfort in outdoor seating situations. Such articles may be self-storing, having manual fasteners such as zippers, snaps and/or straps for containment, and may contain pockets for storing additional items.

For example, U.S. Pat. No. 5,414,881 provides an article that allows the user one of three functional options. The article may be converted to a stadium lap blanket that may include one or more corner pockets for temporarily storing small items, or may be used as a rain covering with storable hood. A closable compartment is provided by means of hook and pile fastening material, and the article may be used as a seat cushion or transported if the entire unit is folded in a predetermined manner, secured by fastening and extending an elongated retaining strap around the body of the article.

Another example is found in U.S. Pat. No. 4,991,245, which provides a portable pillow/lounge set convertible to and from a tote bag with handles. A ground cover sheet is folded and fastened at multiple points to form the generally flat tote bag having a plurality of article-holding compartments of which are also formed by the multiple folding and fastening points. A detachable inflatable pillow and cover sheet are provided, both of which require additional mounting and fastening to use.

U.S. Pat. No. 2,183,418 provides a convertible coverlet and pillow in which the coverlet may be folded and zipped within the pillow for transportation. Detailed instructions are provided for precise folding and zippered storing of the coverlet within the pillow.

Other examples can be found in the following U.S. Pat. Nos. 2,611,899; 3,477,552; 3,381,306; 5,588,749; 5,454,125; 6,353,933; 5,921,626; and 4,190,918.

It is therefore desirable to provide a versatile combination seating comfort article that is compact, simple to manipulate, transport, and use.

SUMMARY OF THE INVENTION

It is the objective of the present invention to obviate or mitigate at least one disadvantage of previous seating comfort articles.

In a first aspect, the present invention provides a seating comfort article comprising a reversible pouch member; and a covering(s) attached to the pouch, which is convertible between a stored position in which the covering is contained within the pouch, and an extended position in which at least a portion of the covering extends from the pouch.

In one embodiment, the covering is a seat pad for covering a seating surface. The seat pad may be a quilted, cushioned, foam filled, inflatable seat pad, or any combination thereof, and may include a water resistant surface for contacting the seating surface. The seat pad may be a self-inflating cushion, and/or may include an extendable ground sheet also storable within a pouch or in an enveloped portion of the seat pad.

The article may further comprise a blanket portion attached to the pouch, which is convertible between a stored position in which the blanket portion is contained within the pouch, and an extended position in which at least a portion of the blanket extends from the pouch. The blanket portion may be composed of fabric, water resistant material, or other materials. The blanket may include one or more pockets, which may be formed from a linear panel of blanket sheeting attached across the width of the blanket. In one embodiment, the pocket panel is top-stitched perpendicular to the blanket width to form a plurality of individual pockets.

In one embodiment, the seating comfort article so described with pouch, blanket and/or cushion, wherein the blanket may be rolled or folded into the pocket member to form a pillow.

In a further embodiment, the seating comfort article as described includes a carry strap that may be elasticized, adjustable, detachable, or any combination thereof.

In an embodiment, the pouch is elasticized or includes an elasticized edge.

In a separate embodiment, the covering is a blanket for covering a user while seated.

In a further embodiment, the article comprises further attachment means for securing accessories to the article.

In another embodiment, the article comprises further attachment means for attaching the article to a seat or wheelchair.

In a second aspect of the invention, the invention provides a method for storing a blanket and/or seat pad comprising the steps of: providing a blanket and/or seat pad having a reversible pouch affixed at one end thereof, the pouch having a certain width and having an opening along the width; folding the blanket and/or seat pad to a width similar to that of the pouch; rolling the folded blanket and/or seat pad towards the pouch; and enclosing the rolled blanket and/or seat pad within the pouch where it is therefore completely self contained.

In one embodiment, the blanket or seat pad is an inflatable seat pad, and the method includes the further step of allowing the seat pad to deflate simultaneously while rolling the blanket and/or seat pad towards the end pouch, and enclosing the roll within the pouch.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a compact self-storing seating comfort article adaptable for use by an individual or group of individuals. The article generally includes a reversible storage pouch, which is attached to a seat pad and/or a blanket. In a preferred embodiment, both blanket and seat pad are present, and each can be rolled or folded independently or simultaneously into the storage pouch for simple transport.

Figure 1:
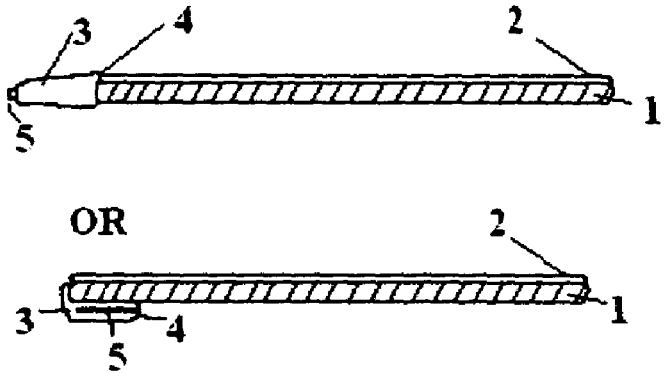
FIG. 1 is a side cross-sectional view of an embodiment of the invention with a seat pad and blanket shown in extended position, with and without the reversible pouch flipped under the seat pad.

In the embodiment of the invention shown in FIG. 1, when the seating comfort article is in the fully extended position to accommodate comfortable seating, the seat pad (1) may be placed against a bench, the ground, or another seating surface by the user, and the user would sit on the seat pad (1) and use the extended blanket portion (2) to cover his or her lap and legs. As shown in FIG. 1, the reversible pouch (3) may be flipped up or folded underneath the seat pad (1), if desired. In a preferred embodiment, the storage pouch (3) includes an elasticized portion (4) so as to simplify conversion of the article between the extended and storage positions, thereby avoiding the inclusion of manual fasteners such Is snaps, zippers or straps.

Figure 2:
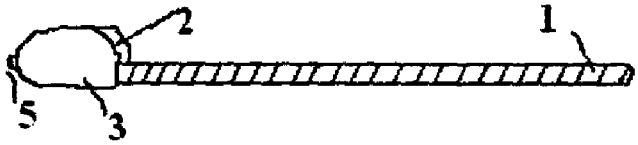
FIG. 2 is a side cross-sectional view of the embodiment shown in FIG. 1, with the blanket rolled within the reversible storage pouch.

With reference to FIG. 2, the blanket (2) may be independently rolled within the pouch (3) for storage in situations where the user does not desire the warmth or protection of the blanket (2). In this configuration, the rolled blanket (2) within the pouch (3) may be used as an armrest or pillow by the user; leaving the extended portion of the seat pad (1) available for comfort use in sitting or lying down.

Figure 3:
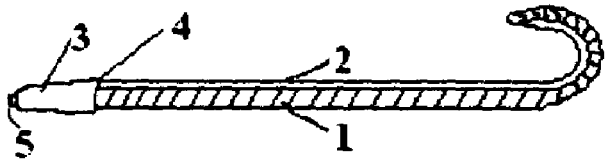
FIG. 3 is a side cross-sectional view of the embodiment shown in FIG. 1 during rolling into a storage position.
Figure 4:
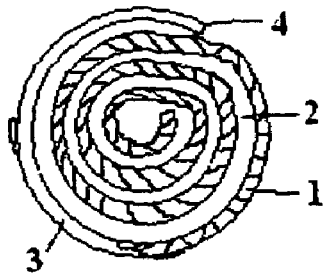
FIG. 4 is a side cross-sectional view of the embodiment shown in FIG. 1 when in the compact storage position with the blanket and seat pad rolled into the storage pouch.
Figure 5:
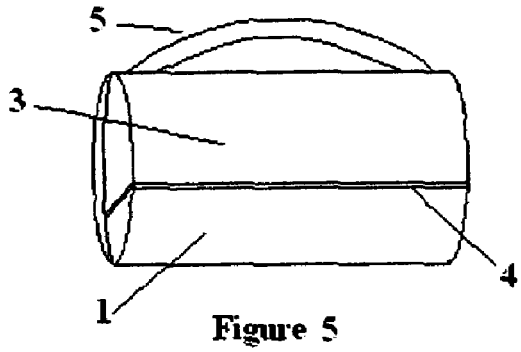
FIG. 5 is a front perspective view of an embodiment of the invention rolled into a compact storage position.

When the user no longer requires comfortable seating accommodation, the blanket (2) may be folded to the shape of the seat pad (1), and the seat pad (1) and blanket (2) may be simultaneously rolled together, as shown in FIG. 3, and tucked into the elasticized pouch (3). Such a rolled compact storage position is shown in cross section view in FIG. 4, and in front view in FIG. 5. The embodiment shown in FIG. 5 further includes a carry strap (5) to facilitate transport of the article and/or attachment of the article to other devices, as will be described below.

Figure 6:
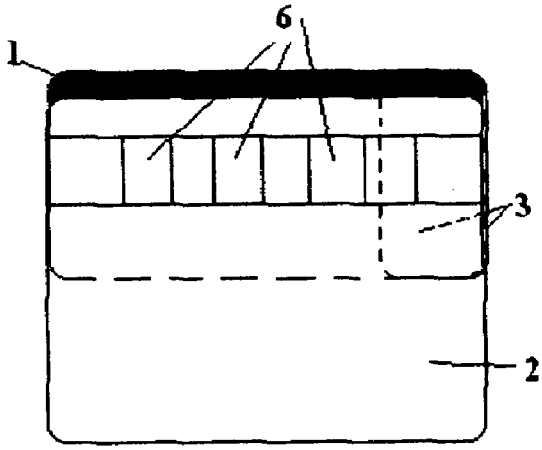
FIG. 6 is a top view of an embodiment of the invention shown with the seat cushion and blanket in fully extended position.

In an embodiment of the invention, the blanket (2) may be extended past the edge of the seat pad (1) to provide warmth and protection to the legs of the user. In addition, the blanket (2) may include other comfort features such as pockets (6) as shown in FIG. 6. The pockets may be used to warm the hands of the user, and/or to store other articles such as mittens, keys, hats, or other articles as desired by the user. The blanket (2) and/or pockets (6) may incorporate attachment means such as snaps or Velcro™ loops for securing such additional articles to prevent inadvertent loss.

Figure 7:
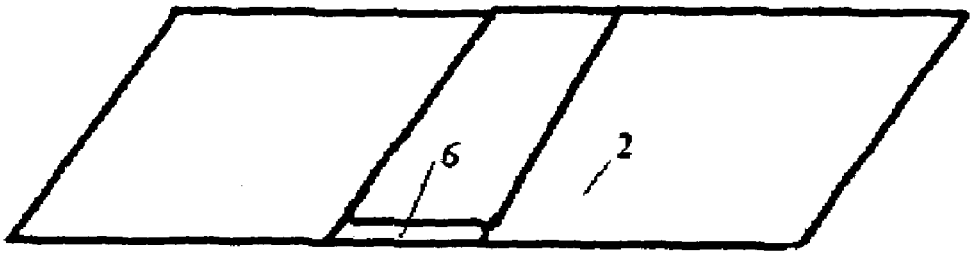
FIG. 7 is a side cross-sectional view of a blanket and pocket in accordance with an embodiment of the invention.

In the embodiment shown in FIG. 7, the blanket (2) includes an elongated pocket panel attached to the blanket fabric. The elongated pocket panel may be top-stitched to create individual pocket portions as shown in FIG. 6.

Figure 8A:
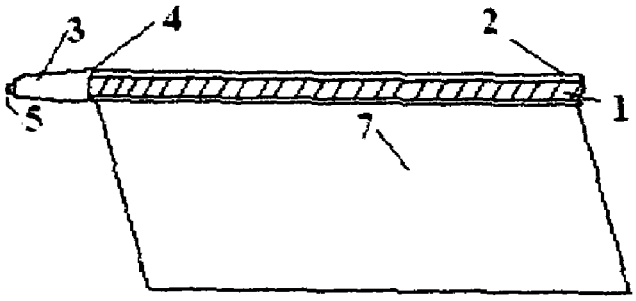
FIG. 8A is a side cross-sectional view of a further embodiment of the invention in which a ground covering is provided.
Figure 8B:
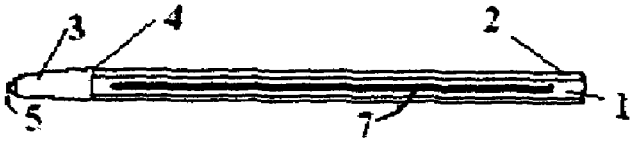
FIG. 8B is a side view of an alternate embodiment of the invention, in which an extendible ground covering is storable within an enveloped cavity portion of the seat pad.
Figure 8C:
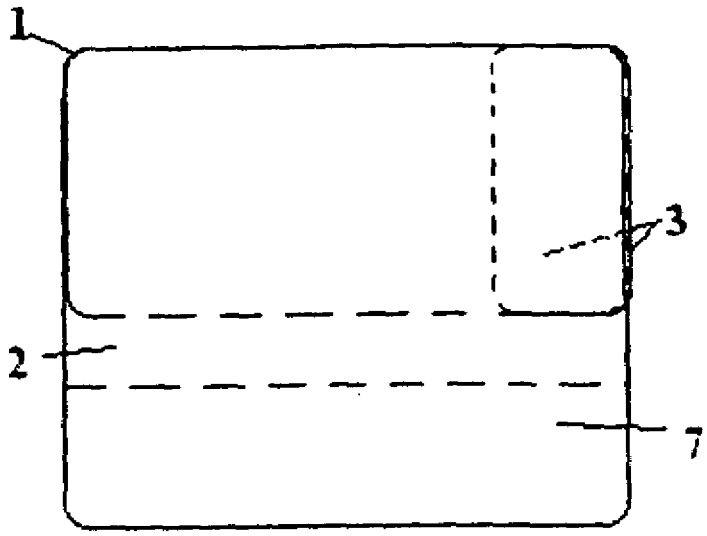
FIG. 8C is a bottom view of the embodiments shown in FIG. 8A and 8B.

In a further embodiment of the article, a ground sheet (7) may be provided as shown in FIGS. 8A, 8B, and 8C. The ground sheet may be independently secured within the pouch (3) as shown in FIG. 8A, or may be folded within a side cavity or enveloped portion of the seat pad (1) as shown in FIG. 8C (B). Incorporation of a ground sheet may be particularly desirable during events at which spectators must seat themselves on the ground, in which case the ground sheet may serve to protect the clothing of the user from the ground surface, which may be damp or dirty. The ground sheet (7) may extend past the edge of the seat pad (1), as shown in FIG. 8B(C). The ground sheet may be composed of water resistant fabric, or may simply be an extension of the seat pad.

Figure 9:
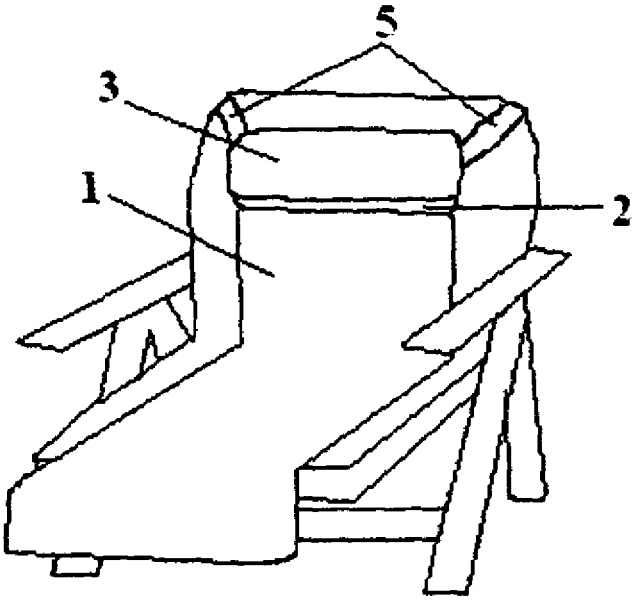
FIG. 9 is a perspective view of an embodiment of the invention shown attached to a chair with the seat pad in extended position and the blanket rolled into the storage, therefore forming a pillowed headrest or neck roll.

The seating comfort article may also be used with conventional chairs and seats as shown in FIG. 9. As shown, a carry strap (5) may be used to secure the article to the chair, and the blanket (2) may be rolled within the pouch (3) to provide a pillow. When not in use, the carry strap (5) may, if present, may be stored within the attached pouch (3). The carry strap may be elasticized or adjustable to provide maximum versatility of the seating comfort article.

Further, the comfort article may include fastener straps or other means of attaching the article to a specialized seat, for example to a wheelchair. In this embodiment, the article may be custom-fitted to the specific needs or desires of the chair in accordance with the invention.

Modifications and Materials

The comfort article may be manufactured to any desired size to accommodate a given number of users, and many modifications to the basic embodiments discussed herein are possible to accommodate specific needs of one or more users. For example, any number of pockets (6) may be included within the blanket (2), and the blanket may be manufactured to any desired length or width.

The seat pad (1), if present, may be quilted, padded, foam-filled, and/or inflatable, and may be water resistant or include a waterproof, skid-resistant portion for placement against the seating surface. In a preferred embodiment, the seat pad (1) is a self-inflating foam-filled pad.

The blanket (2), if present, may be composed of fleece or other blanket fabric, or a water or wind-repellent surface, or any combination thereof.

Use of the Article

Many potential uses of the seating comfort article are inherent in the above description. Additional uses of the article include, but are not limited to:

a). when the seat pad (1) is squarely folded and one end is secured in the reversible pouch, the article may be used as a compact seat cushion, or backrest, with the blanket (2) either folded within the pouch (3) or independently extended for use;

b). when the distal loose end is rolled partially up, the usable form is of an individual seat and back cushion with attached neck roll;

c.) the entire article may be positioned in the reverse of that which is described in b), allowing the pillow pocket portion to be used as a foot covering, in which the blanket may remain housed within the pocket for added foot warmth or extended up and over the legs and lap of the user as desired;

d.) when fully rolled out, the article may include a blanket (2) with or without hand warming pockets in which accessories can be secured, and an attached seat-pad cushion (3), which may incorporate a moisture-proof barrier and may or may not include an additional extendible length of ground covering material. The article is quickly and easily convertible into a compact, self-contained pillow-roll form, and therefore becomes an easily transportable unit with or without a carry strap (5);

e.) the article may be custom-fitted to a particular specialized seating surface which may or may not include the use of fasteners.

f.) the seat pad may be a foam floor mat, for example a yoga mat or exercise mat.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A self-storing seating comfort article, comprising:

a reversible pouch comprising an elasticized opening;

a seat pad convertible between a stored position in which the seat pad is contained within the pouch, and an extended position in which at least a portion of the seat pad extends from the pouch; and a blanket convertible between a stored position in which the blanket is contained within the pouch, and an extended position in which at least a portion of the blanket extends from the pouch;

wherein each of the seat pad and blanket are attached to the pouch member so as to be independently storable within the pouch member.

2. The seating comfort article of claim 1 wherein the seat pad is a mat suitable for use as a ground cover.

3. The seating comfort article of claim 1, wherein the seat pad comprises a quilted, cushioned, foam filled, or inflatable pad.

4. The seating comfort article of claim 1, wherein the seat pad includes a water resistant surface.

5. The seating comfort article of claim 1, wherein the seat pad is a self-inflating cushion.

6. The seating comfort article of claim 1, wherein the blanket comprises a water resistant material.

7. The seating comfort article of claim 1, wherein the blanket is rollable or foldable into the pouch to form a pillow.

8. The seating comfort article of claim 1, further comprising a carry strap.

9. The seating comfort article of claim 8, wherein the carry strap is elasticized.

10. The seating comfort article of claim 8, wherein the carry strap is adjustable.

11. The seating comfort article of claim 8, wherein the carry strap is detachable.

12. The seating comfort article of claim 1, wherein the blanket is of suitable size for placement over the lap of a user seated across the seat cushion.

13. The seating comfort article of claim 1, further comprising attachment means applied to one or more of the pouch, seat pad, and blanket.

14. The seating comfort article of claim 13, wherein the attachment means are suitable for use in attaching the article to a wheelchair.

15. The seating comfort article of claim 13, wherein the attachment means are suitable for use in securing the blanket about a user seated on the seat pad.

16. A method for converting the article of claim 1 from an extended position to a stored position, the method comprising the steps of:

providing the article as in claim 1;

manipulating the blanket or seat pad into a compact form; and enclosing the compact form within the pouch.

17. The method as in claim 16, wherein the seat pad is inflatable, and wherein the method further comprises the step of deflating the seat pad.

18. A self-storing seating comfort article, comprising:

a pouch member;

a seat pad convertible between a stored position in which the seat pad is contained within the pouch, and an extended position in which at least a portion of the seat pad extends from the pouch, the seat pad further comprising an extendable ground sheet storable within a cavity or enveloped portion of the seat pad; and a blanket convertible between a stored position in which the blanket is contained within the pouch, and an extended position in which at least a portion of the blanket extends from the pouch;

wherein each of the seat pad and blanket are attached to the pouch member so as to be independently storable within the pouch member.

19. A self-storing seating comfort article, comprising:

a pouch member;

a seat pad convertible between a stored position in which the seat pad is contained within the pouch, and an extended position in which at least a portion of the seat pad extends from the pouch; and a blanket convertible between a stored position in which the blanked is contained within the pouch, and an extended position in which at least a portion of the blanket extends from the pouch, the blanket further comprising a pocket formed by attachment of a fabric panel to the blanket, the panel comprising several parallel lines of stitching to form a plurality of individual pockets against the blanket;

wherein each of the seat pad and blanket are attached to the pouch member so as to be independently storable within the pouch member.

20. A self-storing seating comfort article, comprising:

a pouch member comprising an elasticized edge;

a seat pad convertible between a stored position in which the seat pad is contained within the pouch, and an extended position in which at least a portion of the seat pad extends from the pouch; and a blanket convertible between a stored position in which the blanket is contained within the pouch, and an extended position in which at least a portion of the blanket extends from the pouch;

wherein each of the seat pad and blanket are attached to the pouch member so as to be independently storable within the pouch member.

* * * * *